US006226942B1

(12) United States Patent
Bonin

(10) Patent No.: US 6,226,942 B1
(45) Date of Patent: May 8, 2001

(54) BUILDING CONSTRUCTION PANELS AND METHOD THEREOF

(76) Inventor: Pete J. Bonin, 8816 Yuba Cir., #1110-C, Huntington Beach, CA (US) 92646

( * ) Notice: Subject to any disclaimer, the term of this patent is extended or adjusted under 35 U.S.C. 154(b) by 0 days.

(21) Appl. No.: 09/247,663

(22) Filed: Feb. 9, 1999

(51) Int. Cl.[7] ..... E04C 1/00

(52) U.S. Cl. ..... 52/309.12; 52/309.11; 52/407.5

(58) Field of Search ..... 52/309.12, 407.5, 52/405.3, 742.14, 745.13, 309.9, 309.11, 649.1

(56) References Cited

U.S. PATENT DOCUMENTS

| | | | | |
|---|---|---|---|---|
| 3,305,991 | * | 2/1967 | Weismann | 52/309.11 |
| 3,872,636 | | 3/1975 | Nicosia . | |
| 4,079,560 | | 3/1978 | Weismann . | |
| 4,104,842 | * | 8/1978 | Rockstead | 52/309.12 |
| 4,241,555 | | 12/1980 | Dickens et al. . | |
| 4,393,633 | * | 7/1983 | Charniga | 52/407.5 |
| 4,530,191 | | 7/1985 | Boisbluch . | |
| 4,559,752 | | 12/1985 | Kieffer . | |
| 4,614,013 | | 9/1986 | Stevenson . | |
| 4,862,660 | * | 9/1989 | Raymond | 52/221 |
| 5,491,945 | * | 2/1996 | Meirick | 52/405.3 |
| 5,771,645 | * | 6/1998 | Porter | 52/220.2 |
| 5,771,648 | * | 6/1998 | Miller | 52/309.12 |

* cited by examiner

*Primary Examiner*—Carl D. Friedman
*Assistant Examiner*—Kevin McDermott
(74) *Attorney, Agent, or Firm*—Gene Scott; Patent Law & Venture Group

(57) ABSTRACT

A building panel may be used for constructing walls, floors, ceilings or roofs. The panel has a wire frame with wire mesh surfaces on opposing sides. The interior of the frame carries a layer of insulation sandwiched between stucco or concrete exterior layers. Spaces are placed between the layers for air flow as for instance in heating or cooling the interior wall of the panel, and conduits may be encased within the insulation or in the spaces for utilities. The method of panel construction uses a grooved planar surface to hold elements of the frame while the insulation layer is sprayed into place. The wire mesh is completed after the insulation is placed and finally the stucco or concrete is placed engaging the wire mesh exterior of the wire frame to provide exterior surfaces of the panel.

4 Claims, 3 Drawing Sheets

BUILDING CONSTRUCTION PANELS AND METHOD THEREOF

BACKGROUND OF THE INVENTION

1. Field of the Invention

This invention relates generally to building construction panels and methods of their construction and assembly, and more particularly to a composite wall construction having a wire frame with medial insulation layer sandwiched between hard exterior layers and a method of its construction.

2. Description of Related Art

The following art defines the present state of this field:

Miller et al, U.S. Pat. No. 5,771,648 describes a pair of EPS foam panels having laterally aligned holes arranged in a rectangular grid. Cross wires or rods extend through the holes. Longitudinally extending wires or rods are located against the interior surfaces of the walls and are welded to the cross rods. Retaining means on the ends of the cross rods are disposed against the exterior surfaces of the walls to provide a sandwich construction firmly to interconnect the walls and the rods.

Stevenson, U.S. Pat. No. 4,614,013 describes an insulated welded wire structural building panel and a method for making such panels are disclosed. The panel has a plurality of parallel trusses joined together with cross wires. Each truss is triangular in cross section. A layer of polyurethane foam is provided in the panel spaced from both the front side and the back side of the panel. On one surface of the foam is a layer of solidified viscous material, such as asphalt or a thermoplastic. The cross wires on opposite sides of the panel are offset from each other along axes of the truss runner wires to which they are welded.

Kieffer, U.S. Pat. No. 4,559,752 describes an invention relating to a three-dimensional monolithic structure of expanded metal formed from an expandable metal place sheet usable in a building construction panel, said structure exhibiting mutually parallel ribs at opposite first and second faces of the structure and inclined cross-struts formed by interrupted cutting lines in the sheet, the cross-struts inwardly joining the ribs at shaped joint nodes of shapes formed by cutting lines.

Boisbluche, U.S. Pat. No. 4,530,191 describes an invention relating to a three-dimensional metal framework, designed for forming isothermic walls of buildings, which comprise an inner air cavity in word form of a blade along one of its faces. This framework comprises rectilinear and parallel rods which are welded, in at least two parallel rows, on sinusoidal wires which extend in planes perpendicular to the rectilinear rods and whose tops are situated in two planes parallel with the two rows of rectilinear rods, the first row of rectilinear rods being furthermore slightly spaced apart from a first one of the planes containing the tops of the sinusoidal wires. The invention also relates to a constructional element built from this framework and comprising a bearing wall and a heat insulating layer both disposed between the two rows of the rectilinear rods of the framework as well as two finishing coverings formed on the tops of the sinusoidal wires of the latter. An air cavity in word form of a blade is therefore formed along one of the finishing coverings. The invention also relates to a process for constructing a constructional element of this type which constitutes an external wall of a house.

Dickens et al., U.S. Pat. No. 4,241,555 describes a building panel having an expanded plastic core with thin reinforcing strips bonded to front and back surfaces of the core, at least along the edges thereof, and may have a wire grid attached in offset relation to one surface thereof for receiving a material such as concrete. The panel is manufactured by a process of expanding a plastic material in a mold by the application of heat to form a core, removing the core from the mold, placing thin reinforcing strips on front and back surfaces of the core with an adhesive system between strips and core, returning the core to the mold and heating the interior of the mold to bond the strips to the core and achieve dimensional stability during molding.

Weismann, U.S. Pat. No. 4,079,560 describes a wire matrix for a construction panel having a plurality of parallel longitudinal trusses, each truss having a pair of parallel longitudinal wire runners and a plurality of transverse wire struts in which the struts associated with one truss are all parallel to each other and extend diagonally between the parallel runners, with the struts in alternate ones of the trusses being parallel and the struts in adjacent trusses being skewed. The trusses are formed by making a grid of parallel longitudinal runners joined by diagonal cross wires which are then cut between adjacent pairs of runners to form separate trusses. The trusses are then joined by transverse wire runners forming a three-dimensional matrix.

Nicosia, U.S. Pat. No. 3,872,636 describes a light metal structural panel which is adapted to replace other forms of wall and partition studding or framing and to which suitable wall coverings are adapted to be secured such as wall board or other desirable sheathing materials, and the like. Prefabricated built-up panel units may utilize the metal structural panel units as body reinforcement for efficient load bearing utility such as in prefabricated walls, partitions, roof decking, floor decking, etc.

The prior art teaches the use of wire core supports for wall panels. However, the prior art does not teach that such panels may be constructed in the manner of the present invention so as to provide the advantages and benefits claimed. The present invention fulfills these needs and provides further related advantages as described in the following summary.

SUMMARY OF THE INVENTION

The present invention teaches certain benefits in construction and use which give rise to the objectives described below.

The present invention provides a building panel useful for constructing walls, floors, ceilings or roofs. The panel has a wire frame with wire mesh surfaces on opposing sides. The interior of the frame carries a layer of insulation sandwiched between stucco or concrete exterior layers. Spaces are placed between the layers for air flow and conduits may be encased within the insulation for utilities. The method of construction uses a grooved planar surface to hold elements of the frame while the insulation layer is sprayed into place. The wire mesh is completed after the insulation is placed and finally the stucco or concrete is placed engaging the wire mesh exterior of the wire frame on opposite sides to provide exterior surfaces of the panel.

A primary objective of the present invention is to provide a mass producible building panel and method of construction having advantages not taught by the prior art.

Another objective is to provide such a building panel that is easily and inexpensively made so as to enable less expensive building construction and wherein the panels may be used for walls, floors and ceilings.

A further objective is to provide such a building panel that is light in weight, fire resistant, insect resistant, stronger than wood frame construction, and flexible so as to withstand high wind and earthquake forces.

A still further objective is to provide such a building panel that is adaptable to be used for heating the interior walls of a dwelling.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
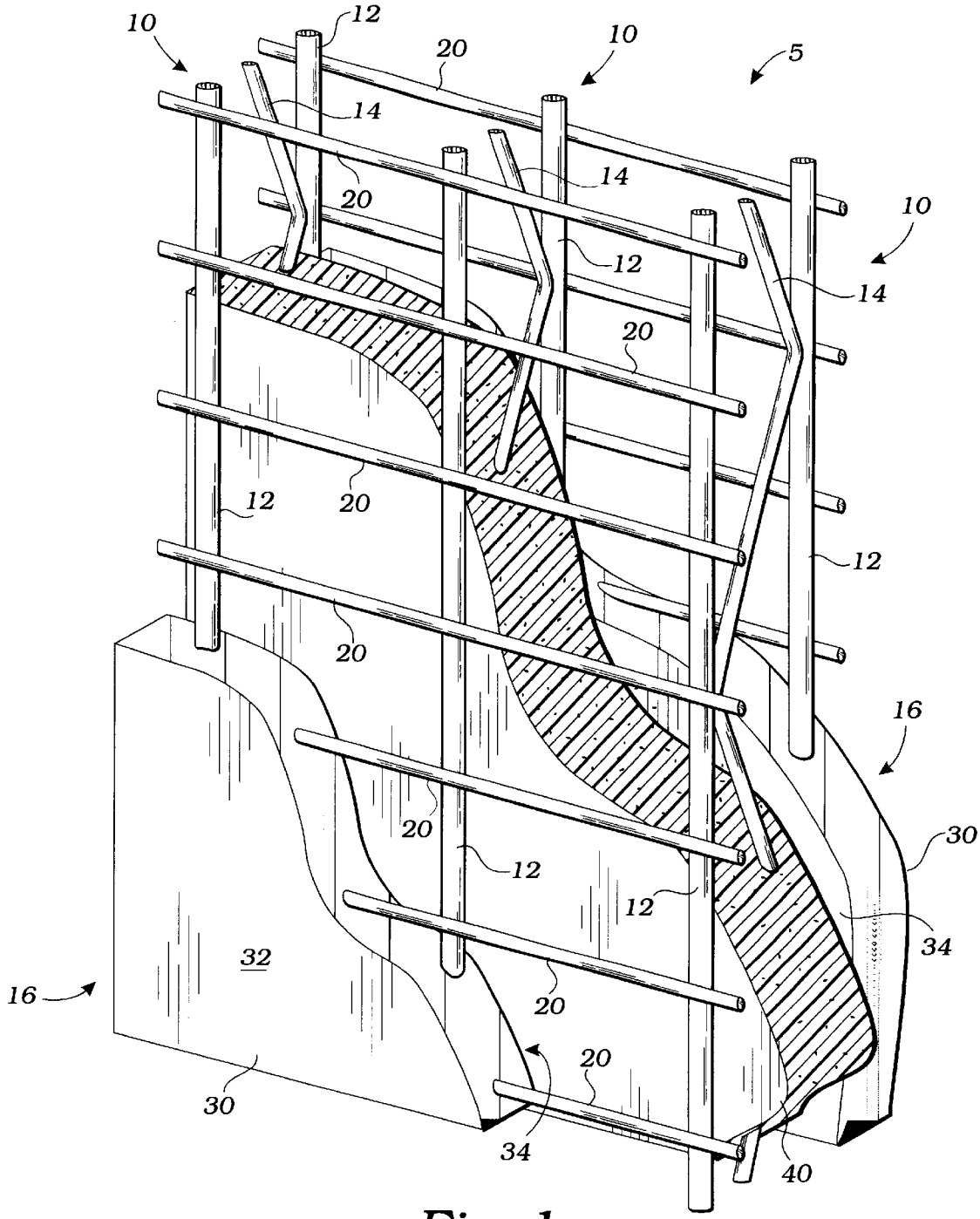
FIG. 1 is a perspective view of the preferred embodiment of the present invention a building construction panel, shown with portions of the various wall layers cut-away for clarity.
Figure 2:
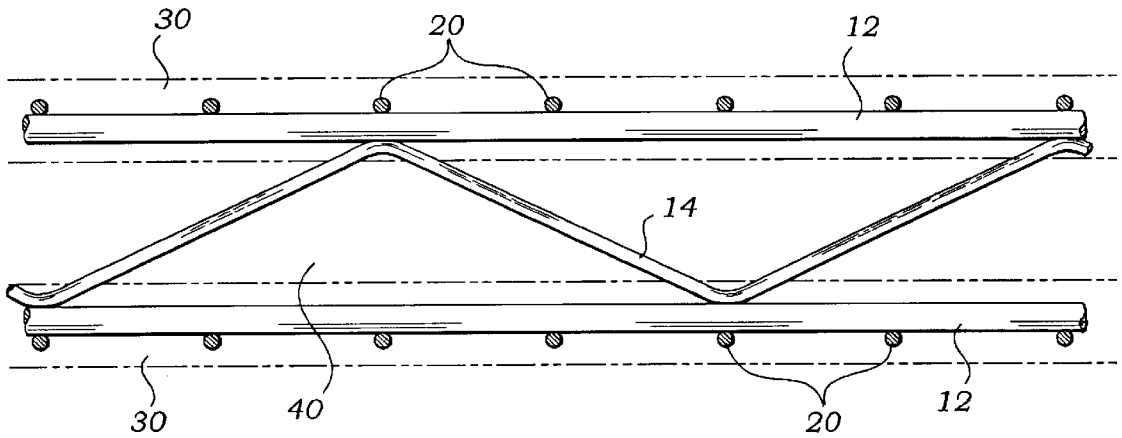
FIG. 2 is a side elevational view thereof with the panel positioned for use as a floor element and showing the wire construction thereof with inner and outer panel layers shown in phantom.

The above described drawing figures illustrate the invention, a wall, floor, ceiling or roof panel apparatus 5 for use in constructing a building. In this description the term "wall panel" shall be used, but floor, ceiling or roof panel applications are included. The panel comprises, as shown in FIG. 1, a plurality of panel studs 10 arranged in spaced apart, side-by-side, parallel positions, each one of the panel studs 10 comprising a pair of spaced apart linear longitudinally oriented steel wires 12 joined, preferably by welding, by a zigzag shaped steel bracing wire 14. Preferably, the diameters of the two wires are the same and the size of the wire is determined by strength requirements in the particular application. It is shown that the longitudinal wires 12 on each common side of the bracing wires 14 establish a pair of opposing faces 16 of the wall panel 5. Each of the wall panel faces 16 further comprise a plurality of linear, laterally oriented wires 20 joined in parallel, spaced apart positions to the longitudinally oriented wires 12; the longitudinally oriented wires 12 and the laterally oriented wires 20 on each of the wall panel faces 16 having sufficient spacing as a planar wire grid network to provide construction slurry functional support thereon, i.e., the slurry 30, a concrete or stucco is able to adhere to the wire grid until it is dry and hard. To assure adherence of the slurry 30 to the wire grid, the lateral and the longitudinal wires are preferably placed no more than between 2 and 3 inches apart. A layer of the construction slurry 30 is engaged with each of the planar wire grid networks so that each of the construction slurry layers 30 is able to provide a wall panel outside wall surface 32 and, in opposition thereto, a slurry layer inside surface 34. A layer of a thermally insulating material 40 is pre-positioned between the two slurry layer inside surfaces 34.

Figure 3:
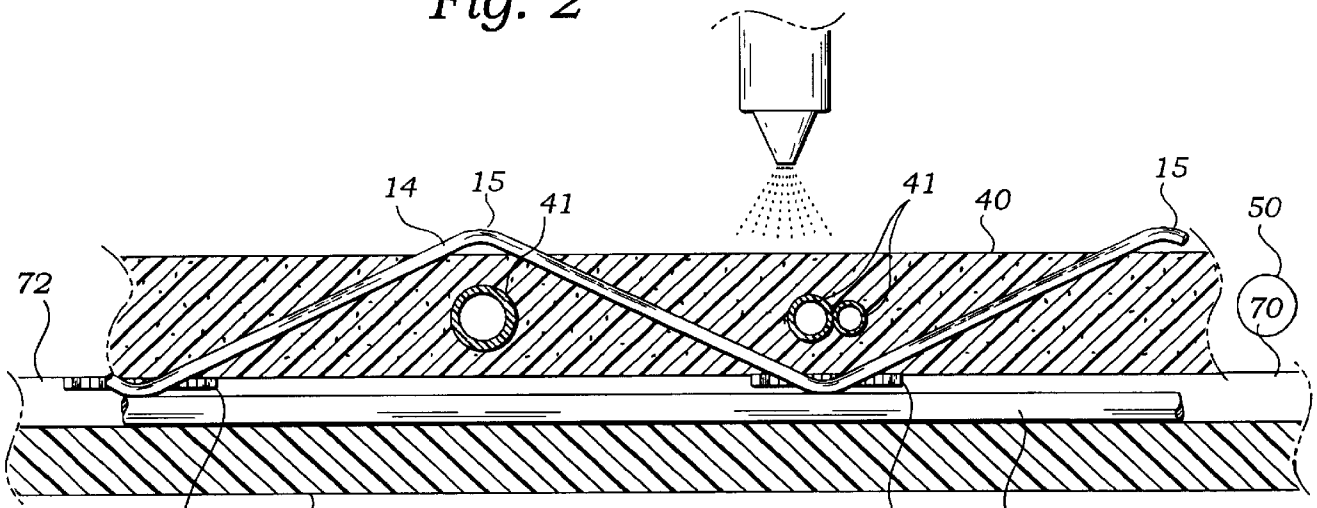
FIG. 3 is a side elevational view thereof showing the method of spraying an insulation layer onto the panel.
Figure 4:
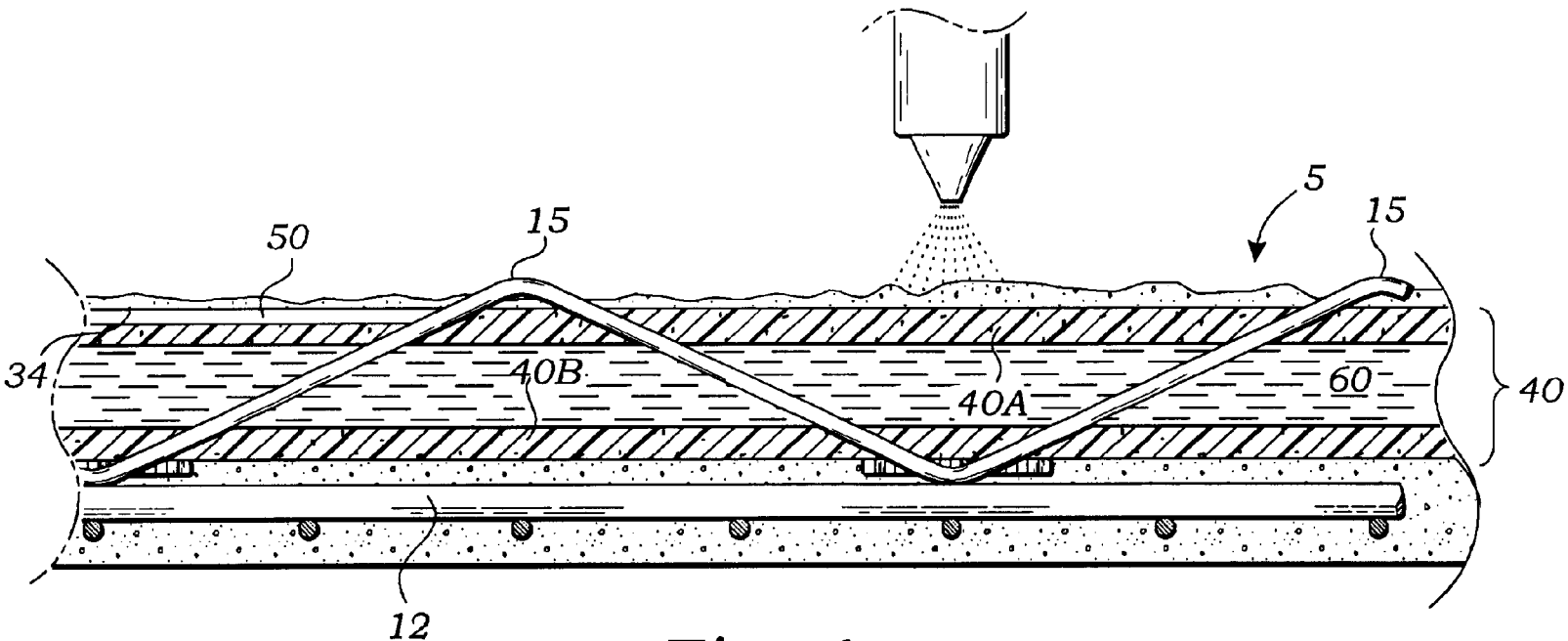
FIG. 4 is a side elevational view thereof showing the method of spraying a finishing layer of stucco onto the panel.

In one embodiment (FIG. 4) of the present invention, the thermally insulating material 40 layer is positioned so it abuts one of the two slurry layer inside surfaces 34 and is spaced apart from the other of the slurry layer inside surfaces 34 defining a first longitudinal space 50 within the wall panel 5 wherein an air flow may be set up within the wall panel 5. Such a space, beside being used for an air flow, for heating and cooling the interior of the panel, is also a noise and thermal insulating means. In another embodiment of the present invention the thermally insulating material 40 layer comprises two spaced apart parallel portions 40A and 40B thereof defining a second longitudinal space 60 within the wall panel 5 for noise and thermal insulation. Clearly, the wall panel 5 may be constructed with both spaces 50 and 60 present as shown in FIG. 4. As shown in FIG. 3 the thermally insulating material 40 layer may, in still another embodiment, encompass at least one conductor 41 for passing water, air, electrical wires, or any other utility desired. Alternately, the conductors may be placed in one or the other of the spaces defined above within the panel. Clearly it will be understood, by one of skill in the art, that spaces in the panel may be left for windows and doors wherein frames for such may be placed prior to installing the insulation so that cracks between the frames and the insulation will not be present.

The method of wall panel construction of the present invention comprises the steps of providing a first plurality of the linear longitudinally oriented wires 12, each one of the first wires joined to one of the zigzag shaped bracing wires 14 and extending outwardly therefrom to establish free ends 15 thereof; inserting one of the linear wires 12 into one of a plurality of parallel grooves 70 in a planar surface 72 of a production fixture 74 so the bracing wires 14 are in parallel planes with the free ends 15 thereof extending from the planar surface 72; covering each of the grooves 70 of the production fixture 74 with a groove cover means 76; spraying a layer of the thermal insulation material 40 onto the planar surface 72 and the groove cover means 76 to a depth not to cover the free ends 15 of the bracing wires 14; curing the thermal insulation material 40 layer so as to form a rigid assembly comprising the linear wires 12, the bracing wires 14, the groove cover means 76 and the thermal insulation material 40 layer; withdrawing the rigid assembly from the production fixture 74; fixing a second one of the plurality of linear longitudinally oriented wires 12 to each of the free ends 15 of each one of the bracing wires 14 so that the first and the second wires are in a spaced apart parallel relationship defining the first and the second wall panel faces 16; fixing a plurality of the laterally oriented wires 20 joined in parallel, spaced apart positions to the longitudinally oriented straight wires 12, the longitudinally oriented wires 12 and the laterally oriented wires 20 on each of the wall panel faces 16 having sufficient spacing as a planar wire grid network to provide construction slurry functional support thereon, preferably spaced apart by between 2 and 3 inches, as previously defined; laying on a layer of the construction slurry 30 engaged with each of the planar wire grid networks, each of the construction slurry layers 30 providing the wall panel outside wall surface 32 and, in opposition thereto, the slurry layer inside surface 34.

Clearly the method defined above may be accomplished wherein the step [(i)] of laying on a layer of a construction slurry 30 engaged with each of the planar wire grid networks, is completed leaving a space between one of the slurry layers 30 and the thermal insulation layer 40 such that the thermally insulating layer 40 abuts one of the two slurry layers 30 and is spaced apart from the other of the slurry layers 30 for air to flow in a longitudinal direction within the wall panel. Also, the method may be completed wherein the step [(d)] of spraying a thermal insulation material 40 onto the planar surface and the groove cover means to a depth not to cover the free ends of the bracing wires 20, is completed leaving a medial space within the thermally insulating layer 40 for air to flow in a longitudinal direction within the wall panel. Alternately, the method may be completed wherein the previously described step [(d)] is completed by encompassing at least one conductor within the insulating material 40.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A construction panel assembly comprising:

a first plurality of linear longitudinally oriented wires, joined to a plurality of zigzag shaped bracing wires extending outwardly therefrom to establish free ends thereof;

a layer of a thermal insulation material fixed onto the bracing wires, the thermal insulation material providing a medial space therewithin;

a second plurality of linear longitudinally oriented wires fixed to the free ends of the bracing wires so that the first wires and the second wires are in spaced apart correspondence;

a plurality of laterally oriented wires in spaced apart positions fixed exteriorly to each of the first and second wires, the first and second wires and the laterally oriented wires establishing a planar wire grid network for supporting a construction slurry thereon;

a layer of a construction slurry fixed onto the first and second wires and the laterally oriented wires so as to provide opposing outside construction surfaces.

2. The assembly of claim 1 wherein the construction slurry and the thermal insulation material are positioned for defining at least one space for air to flow in a longitudinal direction within the construction panel.

3. A method of construction panel assembly comprising the steps of:

a) providing a first plurality of linear longitudinally oriented wires, joined to a plurality of zigzag shaped bracing wires extending outwardly therefrom to establish free ends thereof;

b) spraying a layer of a thermal insulation material onto the bracing wires, while leaving a medial space within the thermal insulation material;

c) curing the thermal insulation material so as to form a rigid assembly comprising the first wires, the bracing wires, and the thermal insulation material;

d) fixing a second plurality of linear longitudinally oriented wires to the free ends of the bracing wires so that the first wires and the second wires are in spaced apart correspondence;

e) fixing a plurality of laterally oriented wires in spaced apart positions to each of the first and second wires, the first and second wires and the laterally oriented wires establishing a planar wire grid network for supporting a construction slurry thereon;

f) laying-on a layer of a construction slurry onto the first and second wires and the laterally oriented wires so as to provide opposing outside construction surfaces.

4. The method of claim 3 further comprising the step of providing at least one space between the construction slurry and the thermal insulation material for air to flow in a longitudinal direction within the construction panel.

* * * * *